US006808006B2

(12) United States Patent
Maesaka et al.

(10) Patent No.: US 6,808,006 B2
(45) Date of Patent: Oct. 26, 2004

(54) DIE-CASTING SYSTEMS AND MACHINES AND METHODS FOR WITHDRAWING CORES IN DIE-CASTING SYSTEMS AND MACHINES

(75) Inventors: Toshihiko Maesaka, Kariya (JP); Koichi Kawaura, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 15 days.

(21) Appl. No.: 10/244,211

(22) Filed: Sep. 16, 2002

(65) Prior Publication Data

US 2003/0051852 A1 Mar. 20, 2003

(30) Foreign Application Priority Data

Sep. 17, 2001 (JP) ..... 2001-281783

(51) Int. Cl.[7] ..... B22D 29/00
(52) U.S. Cl. ..... 164/132; 164/345
(58) Field of Search ..... 164/137, 340, 164/345, 132

(56) References Cited

U.S. PATENT DOCUMENTS

| | | | | | |
|---|---|---|---|---|---|
| 2,214,638 | A | * | 9/1940 | Kux | 164/340 |
| 4,958,676 | A | * | 9/1990 | Kuntz | 164/340 |
| 5,388,632 | A | * | 2/1995 | Bayliss | 164/131 |
| 5,533,564 | A | * | 7/1996 | Alberola et al. | 164/342 |
| 5,615,728 | A | * | 4/1997 | Lee | 164/340 |

FOREIGN PATENT DOCUMENTS

| | | | | |
|---|---|---|---|---|
| JP | 05-200488 | | 8/1993 | B22C/9/10 |
| JP | 6-126417 | * | 5/1994 | B22D/17/22 |

* cited by examiner

*Primary Examiner*—Kiley S. Stoner
*Assistant Examiner*—Kevin P. Kerns
(74) *Attorney, Agent, or Firm*—Knoble Yoshida & Dunleavy

(57) ABSTRACT

A die-casting system includes a core withdrawing device (50). The core withdrawing device is configured independently of a die (D1, D2) and is operable to withdraw a core (d) from the die.

13 Claims, 7 Drawing Sheets

DIE-CASTING SYSTEMS AND MACHINES AND METHODS FOR WITHDRAWING CORES IN DIE-CASTING SYSTEMS AND MACHINES

This application claims priority to Japanese patent application serial number 2001-281783, the contents of which are incorporated herein by reference.

BACKGROUND OF THE INVENTION

1. Field of the Invention

The present invention relates to die-casting systems and machines, into which molten materials are injected into dies under high pressure to cast products. In particular, the present invention relates to techniques for withdrawing cores from dies, which cores are disposed within the dies during a die-casting operation.

2. Description of the Related Art

Apparatus for withdrawing a core from die-casting machines are known. For example, Japanese Laid-Open Patent Publication No. 5-200488 teaches a die-casting machine that includes a core withdrawing apparatus, which is mounted on a die. The core withdrawing apparatus includes a cylinder device that is coupled to a core via a link mechanism in order to withdraw the core.

However, because the core withdrawing apparatus is mounted on the die in the known die-casting machine, the die naturally has a large size. In addition, the core withdrawing apparatus extends from an outer surface of the die as an appendix or projection. In particular, in the case of die-casting systems that exchange two or more dies (i.e., the casting operation is performed by using two dies that are alternately transferred to and from a single die-casting unit in order to increase productivity), large-size dies and a core withdrawing apparatus extending from the die as an appendix are disadvantageous when the die is transferred into and out of the die-casting unit.

SUMMARY OF THE INVENTION

Therefore, it is one object of the present invention to teach improved die-casting systems and machines that can minimize the size of dies.

According to one aspect of the present teachings, die-casting systems are taught that may include one or more core withdrawing device(s). The core withdrawing device(s) may be operable to withdraw a core(s) that is disposed within the die. The core withdrawing device may be arranged and configured independently of the die.

Therefore, the die may be constructed without the core withdrawing device, so that the die may have a small size. As a result, the die can be more easily disassembled for maintenance work. In addition, manufacturing and operation costs may be reduced, because it is not necessary to provide a core withdrawing apparatus for each die.

According to another aspect of the present teachings, the core withdrawing device(s) may be mounted on a support frame. Further, the die may be movable relative to the support frame. According to another aspect of the present teachings, the core withdrawing device(s) may automatically engage the core when the die is opened.

According to another aspect of the present teachings, methods for withdrawing a core(s) from a die in a die-casting system are taught, in particular for a core(s) that is disposed within the die. The methods may comprise withdrawing the core(s) from the die using a core withdrawing device(s) after a casting operation has been completed. The core withdrawing device(s) is preferably independent of the die.

Additional objects, features and advantages of the present invention will be readily understood after reading the following detailed description together with the claims and the accompanying drawings.

DETAILED DESCRIPTION OF THE INVENTION

Figure 1:
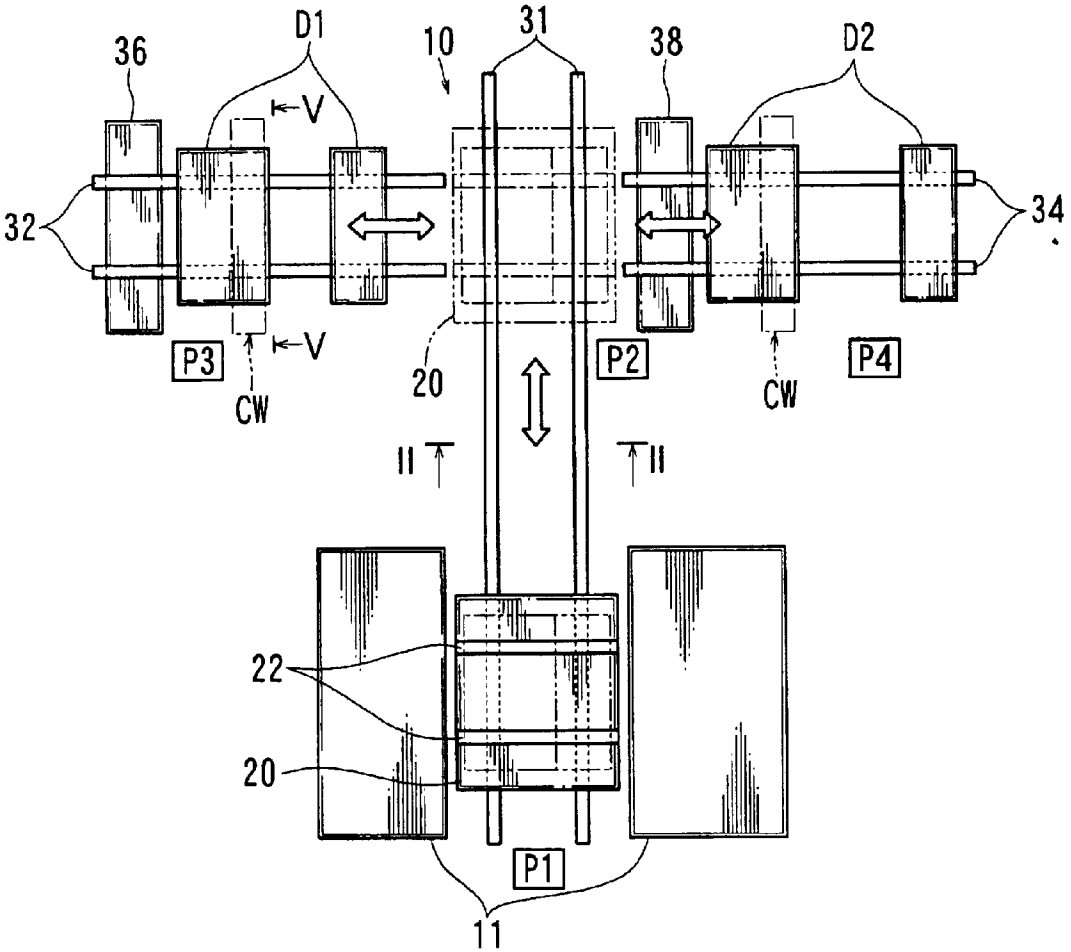
FIG. 1 is a schematic plan view of a representative die-casting system.

In one embodiment of the present teachings, die-casting systems are taught that may include at least one core withdrawing apparatus having at least one core withdrawing device. The core withdrawing device may be operable to withdraw a core from the die, which core may be disposed within the die before the casting operation is performed. The core withdrawing device may be independent of the die.

In another embodiment of the present teachings, the die-casting system may include a die-casting unit. The core may be withdrawn from the die at a carrying-out position, to which the die is conveyed from the die-casting unit. If the die-casting system is configured as a die-exchange type system, in which a plurality of dies are alternately transferred or moved into and out of the die-casting unit for the casting operation, a die conveying apparatus for conveying the die may have a relatively small size.

In another embodiment of the present teachings, the core withdrawing device may include a cylinder for withdrawing the core. Optionally, the core withdrawing device may further include a counterbalancing device that can support the die in order to counterbalance a force that is applied to the core in a core withdrawing direction when the core is withdrawn by actuation of the cylinder.

Generally speaking, after the casting operation has been performed, the core may closely adhere to the cast product. Therefore, a relatively large force is typically required to withdraw the core. The cylinder may reliably provide the necessary force in order to withdraw the core. In addition, when the core is withdrawn, a relatively large reaction force may be applied to a support structure of the cylinder. However, the counterbalancing device may support the die and counterbalance the force in the core withdrawing direction applied to the core. Therefore, the reaction force applied to the support structure may be minimized or may be substantially avoided.

In another embodiment of the present teachings, a clearance may be provided for the counterbalancing device. The clearance may permit movement of the core withdrawing device in the core withdrawing direction relative to a support member that supports the core withdrawing device. In this case, when the core is withdrawn from the die by the cylinder, the counterbalancing device may move relative to the die in a direction that reduces the clearance at a predetermined distance and may support the die. Therefore, the withdrawing force may be impulsively applied to the core. As a result, even if the core closely adheres to the cast product within the die, the core can be easily removed.

In another embodiment of the present teachings, the core withdrawing device preferably engages the core when the die is opened after the die has been removed from the die-casting unit. Therefore, the core withdrawing device does not require any special device for engaging the core. In addition, because core withdrawing device may engage the core at the same time that the opening operation of the die is completed, the production cycle time can be shortened during the casting operation. Optionally, the die preferably may be opened in the horizontal direction.

In another embodiment of the present teachings, methods for withdrawing a core from a die in a die-casting system are taught. The core may be disposed within the die before the casting operation is initiated. The method may include withdrawing the core from the die using a core withdrawing device after the casting operation has been completed. The core withdrawing device preferably may be independent of the die.

Each of the additional features and teachings disclosed above and below may be utilized separately or in conjunction with other features and teachings to provide improved die-casting systems and machines and methods for designing and using such die-casting systems and machines. Representative examples of the present invention, which examples utilize many of these additional features and teachings both separately and in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

A representative die-casting system 10 will now be described with reference to FIGS. 1 and 2, which show a schematic plan view of the die-casting system 10 and a cross-sectional view taken along line II—II in FIG. 1, respectively.

Referring to FIG. 1, the die-casting system 10 may be configured as a die-exchange type system, in which two dies D1 and D2 are exchangeably transferred or moved into and out of a single die-casting unit 11 in order to cast products. The die-casting unit 11 may be configured to clamp and close the dies D1 and D2 and also to inject molten (or liquefied) materials into the dies D1 and D2. In addition to the die-casting unit 11, the die-casting system 10 may include a single carriage 20 for moving or transferring the dies D1 and D2 into and out of the die-casting unit 11, a pair of parallel carriage rails 31 for movably supporting the carriage 20, and two pairs of parallel die rails 32 and 34 for transferring the dies D1 and D2.

When the die D1 (or D2) has been transferred to casting position P1, the die-casting unit 11 may clamp the die D1 (or D2) to close the die and then inject molten materials into a cavity (not shown) of the die D1 (or D2). Thus, the die-casting unit 11 may include a clamping device (not shown) that serves to clamp the dies D1 (or D2) in a horizontal direction by applying pressure against the rear surface of the die. The die-casting unit 11 also may include a molten material injecting device that serves to inject the molten material into the die D1 (or D2) after the die has been clamped.

Preferably, the carriage rails 31 and the die rails 32 and 34 may be arranged to form a T-shape in a plan view as shown in FIG. 1. The carriage rails 31 may extend from casting position P1 to carrying-out position P2 and may serve to provide a moving path of the carriage 20, onto which either the die D1 or D2 is loaded. In addition, the carriage 20 may be supported on the carriage rails 31 via a pair of sliders 21. In this case, the carriage 20 can slidably move in forward and rearward directions as indicated by an arrow in FIG. 1.

Figure 2:
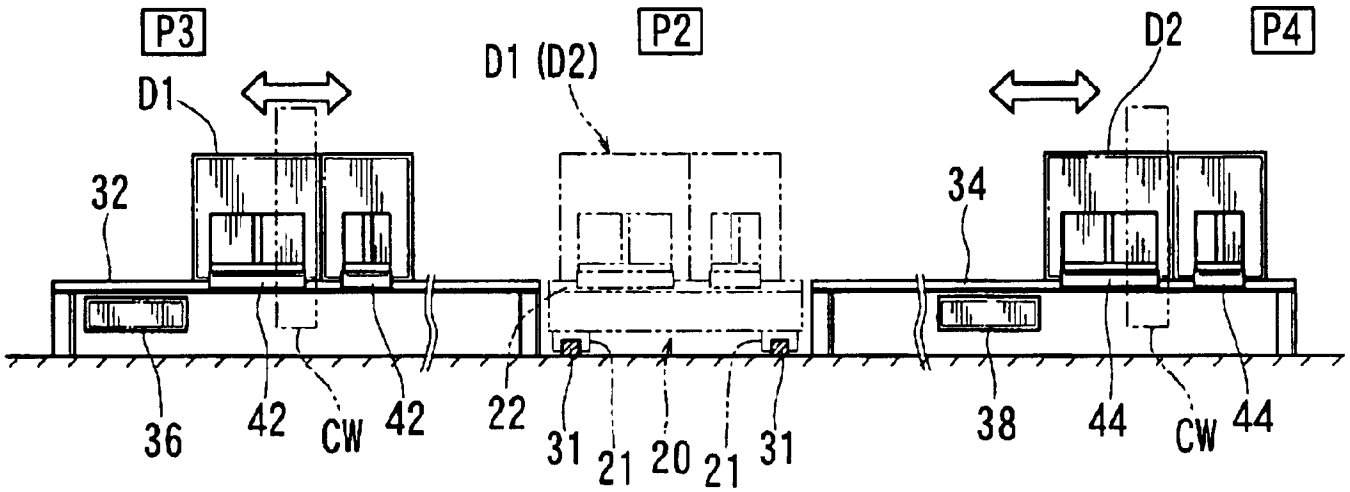
FIG. 2 is a cross-sectional view taken along line II—II shown in FIG. 1.

Referring to FIGS. 1 and 2, the die rails 32 may extend between carrying-out position P2 and opening/closing position P3. The die rails 34 may extend between carrying-out position P2 and opening/closing position P4. Thus, the die rails 32 and 34 may serve to provide branch paths that branch from the carrier rails 31 at carrying-out position P2.

The die carriage 20 may include on-carriage rails 22 that extend substantially perpendicular to the carriage rails 31. The on-carriage rails 22 may align with the die rails 32 and 34 when the carriage 20 is positioned at the carrying-out position P2. Thus, the on-carriage rails 22 and the die rails 32 and 34 may extend in series along a linear path. Therefore, when the die D1 with the cast product has been moved to carrying-out position P2, the die D1 can smoothly transfer from the on-carriage rails 22 to the die rails 32 with the aid of the sliders 42. The die D1 that has been transferred to the die rails 34 may then be opened in the horizontal direction by a corresponding die-opening apparatus 36.

Similarly, when the die D2 with the cast product has been moved to carrying-out position P2, the die D2 can smoothly transfer from the on-carriage rails 22 to the die rails 34 with the aid of the sliders 44. The die D2 that has been transferred to the die rails 34 may then be opened in the horizontal direction by a corresponding die-opening apparatus 38. Although not shown in the drawings, the die carriage 20 may include a clamp device that can clamp and unclamp the die D1 or D2 with respect to the die carriage 20.

The die-opening apparatus 36 and 38 are movable in parallel to the die rails 32 and 34 and serve to transfer the dies D1 and D2 between carrying-out position P2 and opening/closing positions P3 and P4, respectively. For example, the die-opening apparatus 36 and 38 may each include high-pressure cylinders (not shown) that may perform an initial die-opening operation of the dies D1 and D2 with cast products when the dies are transferred from carrying-out position P2 to opening/closing positions P3 and P4, respectively. The die-opening apparatus 36 and 38 also may each include low-pressure and long-stroke cylinders (not shown) that may be mounted on the dies D1 and D2. The low-pressure and long-stroke cylinders may perform a subsequent die-opening operation of the dies D1 and D2 after (or during) the initial die-opening operation. Further, the low-pressure, long-stroke cylinders may serve to close the dies D1 and D2 after the cast products have been removed from the respective dies D1 and D2.

Figure 3:
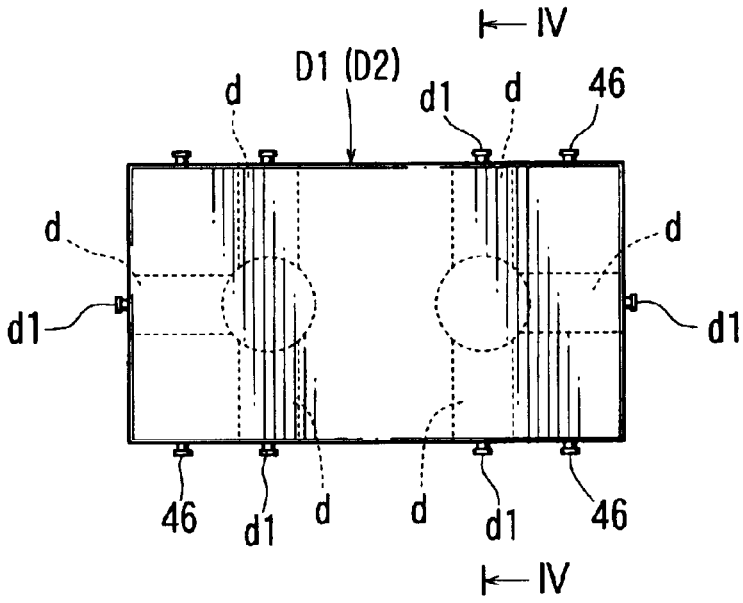
FIG. 3 is a schematic view showing a die and two cores.
Figure 4:
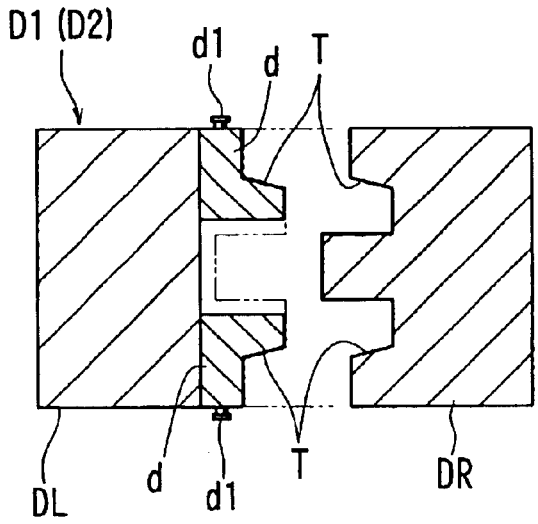
FIG. 4 is a cross-sectional view taken along line IV—IV shown in FIG. 3.

Two core withdrawing apparatus CW may serve to withdraw cores d from the dies D1 and D2 that have been opened, respectively, and will now be described with reference to FIGS. 3 to 8. Optionally, the two core withdrawing apparatus CW may each have the same construction. For the purpose of illustration, the dies D1 and D2 will be described based upon the assumption that dies D1 and D2 have the same construction. Referring to FIGS. 3 and 4, the cores d are schematically shown in the assembled state within the die D1 (or D2). In this representative embodiment, each die D1 (D2) may be designed to cast two products and three cores d may be used for each cast product. Thus, six cores d may be disposed within the die D1 (D2).

Referring to FIG. 4, the die D1 (D2) may include a left-side die part DL and a right-side die part DR. The cores d may be mounted on the left-side die part DL in such a manner that the cores d can move in the directions that are perpendicular to the mating surface between the left-side die part DL and the right-side die part DR. Tapered surfaces T may be formed on the cores d and the right-side die part DR so as to cooperate with each other. In this case, the cores d may be pressurized by the right-side die part DR so as to be fixed in position relative to the right-side die part DR when the die D1(D2) is closed.

Figure 5:
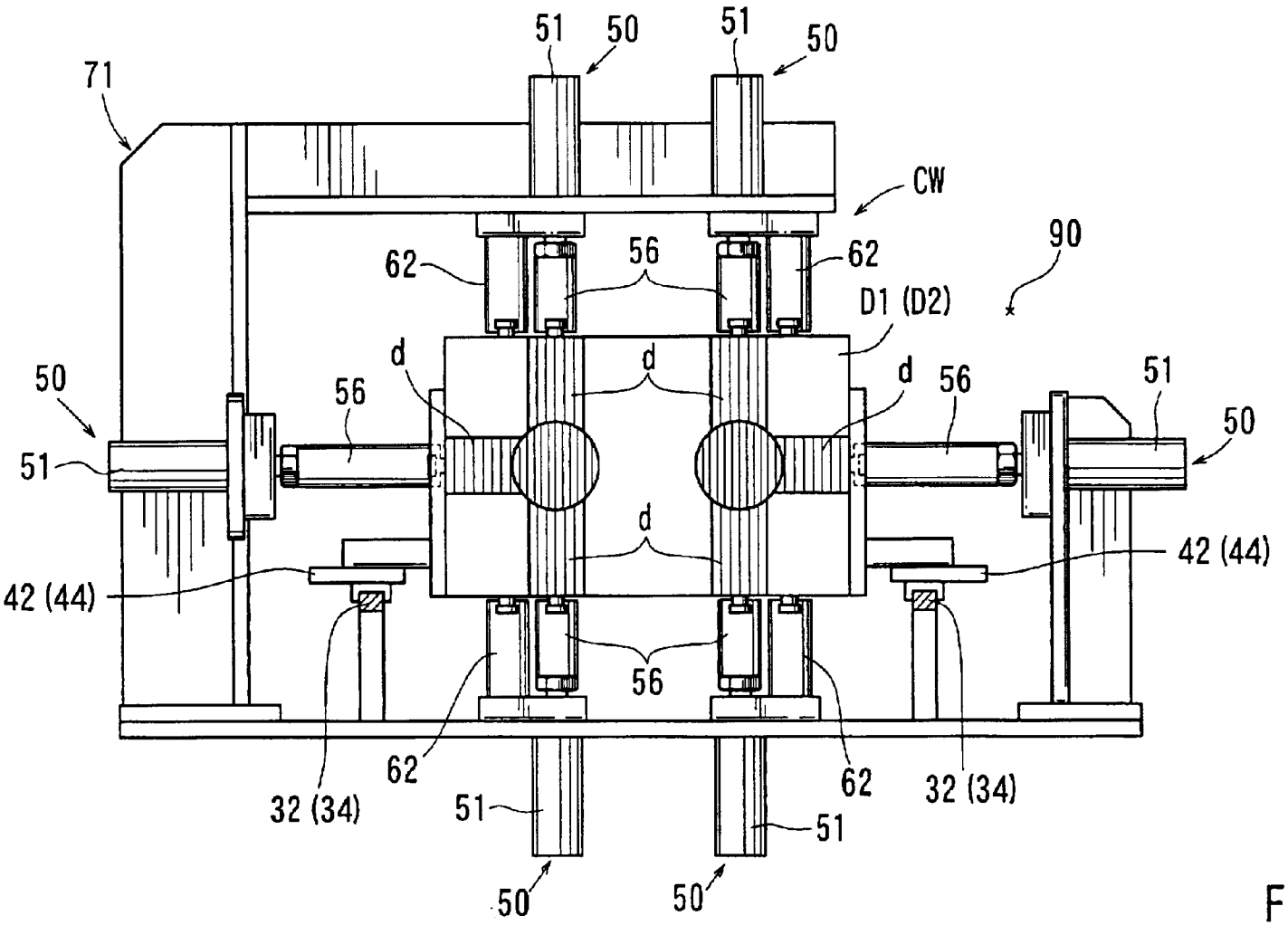
FIG. 5 is a cross-sectional view taken along line V—V shown in FIG. 1.

The core withdrawing apparatus CW may be configured or constructed independently of dies D1 and D2 and may be disposed adjacent to opening/closing positions P3 and P4 for the dies D1 and D2, respectively. As shown in FIG. 5, which shows a cross sectional view taken along line V—V shown in FIG. 1, each core withdrawing apparatus CW may include six core withdrawing devices 50 that are disposed so as to correspond to the six cores d. In this representative embodiment, two core withdrawing devices 50 are disposed on the upper side of the die rails 32 (34), two core withdrawing devices 50 are disposed on the lower side of the die rails 32 (34), and the remaining two core withdrawing devices 50 are disposed on the right and left sides as viewed in FIG. 5. The core withdrawing apparatus CW may be supported by respective support frames 71 (only one support frame 71 is shown in the drawings).

In the representative embodiment, each of the core withdrawing devices 50 may have the same construction. Therefore, one core withdrawing device 50 will be described in further detail with reference to FIGS. 6 to 8. The core withdrawing device 50 may include a withdrawing cylinder 51. The withdrawing cylinder 51 may be mounted on the support frame 71 such that the extending and retracting direction of a piston rod 53 of the withdrawing cylinder 51 coincides with a withdrawing direction for the corresponding core d. A joint 56 may be attached to the front end of the piston rod 53 and may be configured to engage or to be coupled with an engaging hook d1 that is mounted on the outer surface of the core d. The engaging hook d1 may be configured as a headed pin that has a substantially T-shape in a side view so as to extend from the outer surface of the left-side die part DL.

The joint 56 may include a substantially T-shaped engaging recess 57 that can engage the engaging hook d1. The engaging recess 57 may extend horizontally throughout the thickness of the joint 56 in the lateral direction, which is perpendicular to the opening direction of the die D1 (D2). The engaging hook d1 of the core d may engage the engaging recess 57 in the horizontal direction when the left-side die part DL moves in the horizontal direction during the opening operation of the die D1 (D2). For example, the die D1 (D2) with the cast product may be transferred to the die rails 32 (34) and then may be opened by moving the left-side die part DL relative to the right-side die part DR. As the left-side die part DL thus moves in the opening direction, the engaging hook d1 of the core d may automatically engage the engaging recess 57 of the joint 56. When the left-side die part DL moves toward the right-side die part DR in order to close the die D1 (D2), the engaging hook d1 may automatically disengage from the engaging recess 57.

In addition, the joint 56 of the core withdrawing device 50 can be moved between a rest position and an operational position by actuation of the cylinder 51. In the rest position, the joint 56 may be positioned so as to be spaced away (displaced) from the die D1(D2) and preferably does not engage the engaging hook d1. In the operational position, the joint 56 may engage the engaging hook d1 as described above.

The two core withdrawing devices 50 that are disposed in the horizontal direction may be operated at a different time from the four core withdrawing devices 50 that are disposed in the vertical direction. Thus, when the die D1 (D2) has been completely opened, the engaging hooks d1 of the cores d may automatically engage the corresponding engaging recesses 57 of the joints 56 of the six core withdrawing devices 50. Then, the withdrawing cylinders 51 of the two horizontal core withdrawing devices 50 may be actuated to retract their piston rods 53. In this case, the horizontal cores d may be withdrawn from the left-side die part DL as indicated by broken lines in FIG. 6.

Thereafter, the withdrawing cylinders 51 of the four vertical core withdrawing devices 50 may be actuated so as to retract or withdraw their respective piston rods 53. As a result, the vertical cores d may be withdrawn from the left-side die part D1. After withdrawing the cores described above, a product removal operation, a washing operation for die cavity surfaces, a spraying operation of a die releasing agent may then be performed in this order. After completion of these operations, the die D1 (D2) may be closed by moving the left-side die part DL toward the right-side die part DR. Prior to such die closing operation, the withdrawing cylinders 51 of the six core withdrawing devices 50 may be actuated to move the cores d toward the left-side die part DL, so that the cores d may be set into the left-side die part DL.

Figure 6:
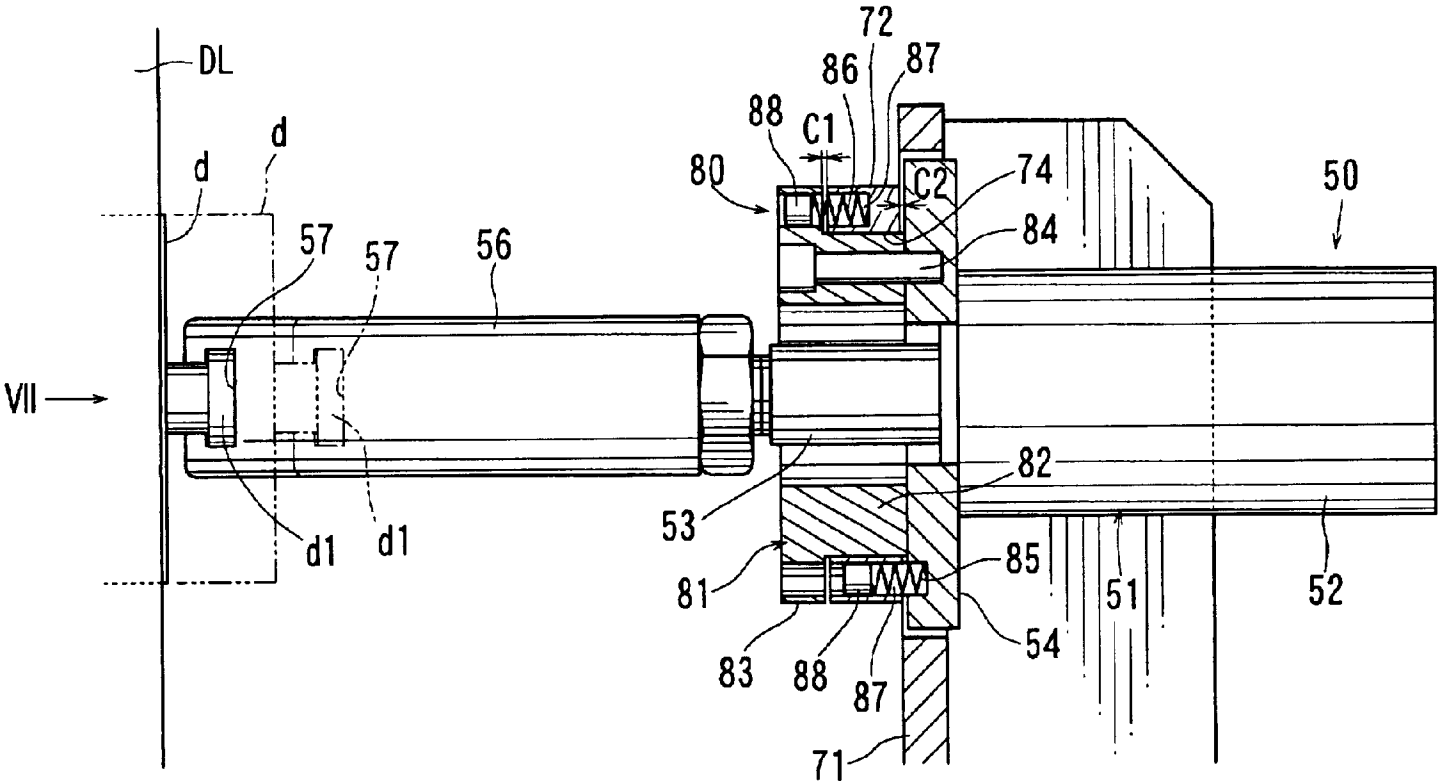
FIG. 6 is a partial, cross-sectional side view showing a core withdrawing device and a floating mechanism.

Optionally, the core withdrawing device 50 may be supported on the support frame 71 via a floating support mechanism 80. In this case, the core withdrawing device 50 can move relative to the support frame 71 in the core withdrawing direction. As best shown in FIG. 6, in order to support the cylinder 51, the floating support mechanism 80 may include a support plate 72 that is secured to the support frame 71 by a suitable number of bolts 73. A circular mounting hole 74 may be defined within the support plate 72 and may serve as a cylinder mounting hole.

A mounting plate 54 may be fixed to a front end (on the side of the piston rod 53) of a cylinder body 52 of the cylinder 51. A movable plate 81 may be fixed to the mounting plate 54 by a plurality of bolts 84. The movable plate 81 may include a cylindrical portion 82 and a collar 83. The cylindrical portion 82 may be slidably fitted into the mounting hole 74 of the support plate 72. Further, the collar 83 may oppose to the outer surface of the support plate 72 in such a manner that support plate 72 is held between the collar 83 and the mounting plate 54.

Preferably, the length of the cylindrical portion 82 may be set to be greater than the thickness of the support plate 72. In the case, the cylinder body 52 can axially move by a distance that corresponds to the difference between the length of the cylindrical portion 81 and the thickness of the support plate 72. A plurality of compression springs 85 may be arranged in the circumferential direction of the support plate 72 and may be disposed between opposing surfaces of the support plate 72 and the mounting plate 54 in order to normally maintain a clearance C1 between these opposing surfaces. Also, a plurality of compression springs 86 may be arranged in the circumferential direction of the support plate 72 and may be disposed between opposing surfaces of the support plate 72 and the collar 83 in order to normally maintain a clearance C2 between these opposing surfaces. As a result, the cylinder 51 can move relative to the support plate 72 in the axial direction within a range of C1+C2.

Preferably, the compression springs 85 and 86 may be disposed within corresponding recesses 87 formed in the support plate 72 and/or the mounting plate 54 and may be concealed by screws 88. As a result, the operation of the compression springs 85 and 86 may be stabilized.

Figure 7:
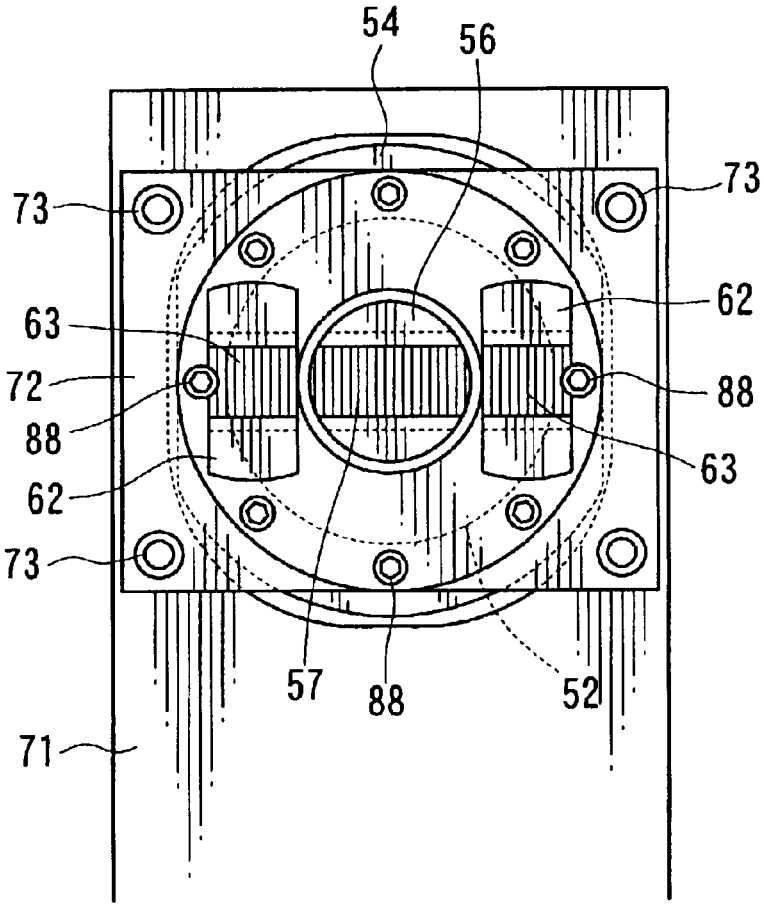
FIG. 7 is a view as viewed in the direction of arrow VII shown in FIG. 6.
Figure 8:
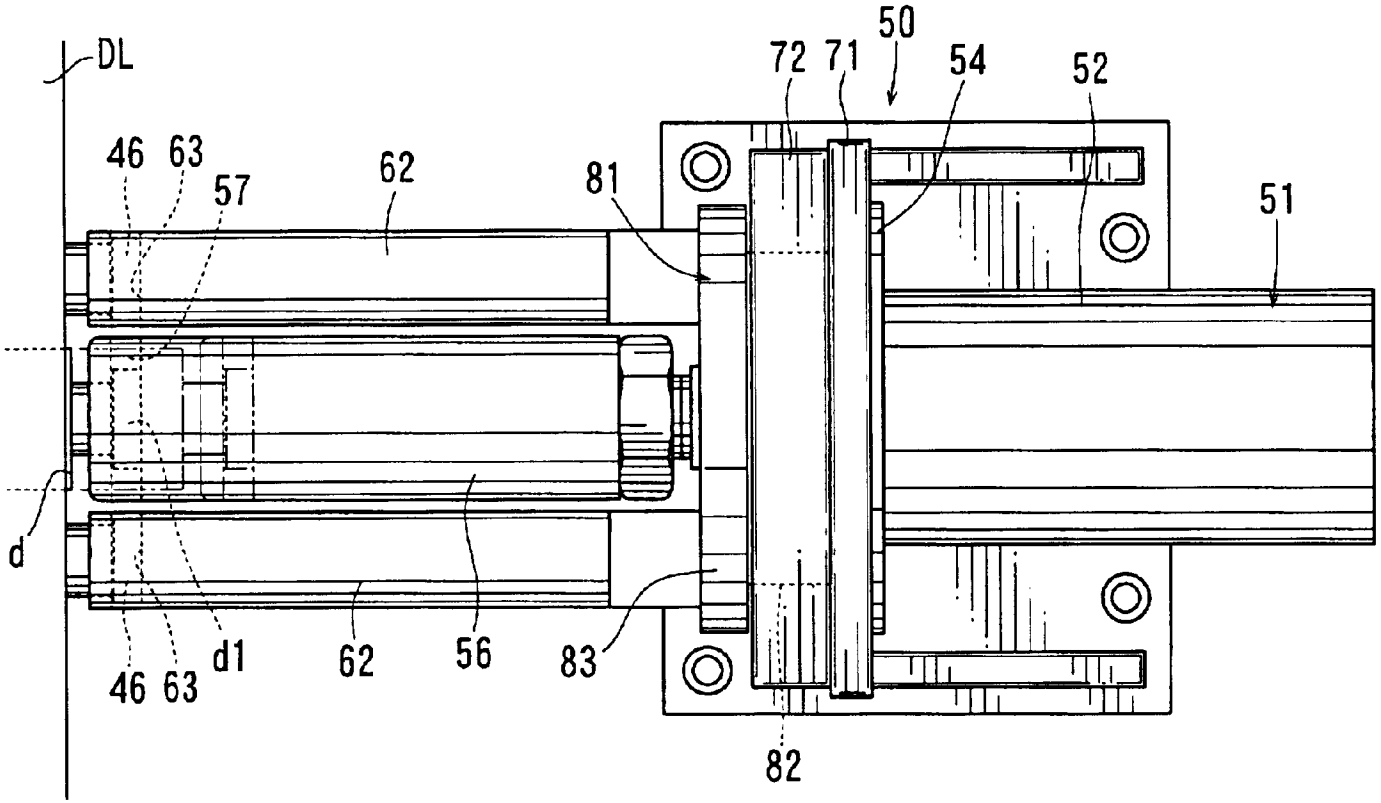
FIG. 8 is a plan view of FIG. 6.

Further, each of the core withdrawing devices 50 may include a strut 62 that may abut the die D1(D2) when the cylinder 51 withdraws the corresponding core d in order to counterbalance the force of the core d in the withdrawing direction. In this way, the strut 62 may serve as a counterbalancing device. As shown in FIG. 5, the strut 62 of each vertical core withdrawing devices 50 may be disposed on the outside (with regard to the plane that is perpendicular to the opening direction of the die D1 (D2)) of the joints 56 and may extend in parallel to the joint 56. Furthermore, as shown in FIGS. 7 and 8, a pair of the struts 62 may be disposed on both sides of the joint 56 of each horizontal core withdrawing devices 50 and may extend in parallel to the opening direction of the die D1 (D2).

The base end of each strut 62 may be secured to a movable plate 81. An engaging recess 63 may be defined within the tip or terminal end of each strut 62. When the die D1 (D2) has moved to the opening position along the die rails 32 (34), the engaging recess 63 may engage a corresponding projection 46 formed on the outer side surface of the left-side die part DL. The projection 46 may have a T-shaped configuration that is substantially the same as the engaging hook d1 formed on the core d. Accordingly, the engaging recess 63 of the strut 62 may have a T-shaped configuration that is substantially the same as the engaging recess 57 of the joint 56 and opens laterally in the opening direction of the die D1 (D2).

A representative method for operation the above-described representative die-casting system 10 will now be described. The dies D1 and D2 may be alternately transferred or moved into and out of the die-casting unit 10. Further, molten material may be injected into the cavities of the dies D1 and D2, when the dies D1 and D2 have brought to carrying-out position P1. Although the dies D1 and D2 have the same construction in this representative embodiment, they may have different constructions from each other. In addition, only one of the dies D1 and D2 may be used for the die-casting operation.

For example, after completion of the casting operation, the die D1 may be conveyed to the carrying-out position P2 via the die carriage 20. The die D1 may be subsequently transferred from the on-carriage rails 22 of the die carriage 20 to the die rails 32. Then, the die D1 on the die rails 32 may be opened in the horizontal direction by the corresponding die opening apparatus 36. Thereafter, the corresponding core withdrawing devices 50 may be actuated to withdraw the cores d and the cast products may be removed from the die D1. Finally, a die releasing agent may be sprayed onto the surface of the die D1.

After or during the above process, the die D2, which is rest at opening/closing position P4 and has been opened to remove the cast product, may be transferred to carrying-out position P2 along the die rails 34. Subsequently, the die D2 may be transferred from the die rails 34 to the on-carriage rails 22 on the die carriage 20 in exchange for the die D1 and may be conveyed to casting position P1.

A representative method for operating the core withdrawing apparatus CW will now be described. For example, after the casting operation, the die D1 with the cast product may be conveyed from casting position P1 to carrying-out position P2 and then may be conveyed to opening/closing position P3 along the die rails 32 by the die opening apparatus 36. During the transportation from the carrying-out position P2 to the opening/closing position P3, the die D1 may be opened in the horizontal direction. As the die opening operation is completed, the engaging hooks d1 of the cores d provided in the left-side die part DL may engage the engaging recesses 57 of the joints 56 of the corresponding core withdrawing devices 50. At the same time, the projections 46 formed on the left-side die part DL may engage the engaging recesses 63 of the corresponding struts 62.

Then, the cylinders 51 of the core withdrawing devices 50 may be actuated to retract their piston rods 53, so that the cores d in the left-side die part DL can be withdrawn as indicated by broken lines in FIGS. 6 and 8. As the cylinders 51 retract, the cylinders 51 will be pulled toward the die D1 by the reaction force of the retracting movement. Thus, the struts 62 will push the corresponding projections 46. Therefore, the force in the withdrawing direction applied to the cores d during the withdrawing operation of the cores d caused by the cylinders 51 may be counter balanced.

The cores d may be inserted into the die D1 prior to the closing operation of the die D1. For example, the cylinders 51 may be actuated so as to cause the piston rods 53 to protrude or project in the extensional direction. Due to such actuation of the cylinders 51, the struts 62 may pull the left-side die part DL via the corresponding projections 46. Therefore, the force in the inserting direction applied to the cores d during the inserting operation of the cores d may be counterbalanced in the same manner as the force in the withdrawing direction.

As the die is closed after completion of the inserting operation of the cores d, the joints 56 and the struts 62 may disengage from the cores d and the left-side die part DL, respectively so that they may be separated from the die D1.

As described above, according to the representative die-casting system 10, the core withdrawing apparatus CW, which includes the core withdrawing devices 50, may be configured or constructed independently of the corresponding die D1 (D2). Therefore, the die D1 (D2) may be constructed without the core withdrawing apparatus CW and the die D1 (D2) may have a relatively small size. As a result, the die D1 (D2) can be easily disassembled for maintenance work. In addition, costs may be reduced, because the necessary number of core withdrawing apparatus CW is not proportional to the number of the dies D1 (or D2).

Further, according to the representative die-casting system 10, after the casting operation, the die D1 (D2) may be carried out of the die-casting unit 11, and the withdrawing operations of the cores d may be performed at the opening/closing position P3 (P4). Therefore, in case of the die-exchange type die-casting system as in the representative die-casting system 10, in which the casting operation is performed by alternately transferring the dies D1 and D2 into and out of the die-casting unit 11, the die carriage 20 and the die opening apparatus 36 and 38, which may constitute a die transferring system, may be configured to have small sizes, because the dies D1 and D2 do not include the core withdrawing devices 50 as appendixes.

Furthermore, according to the representative core withdrawing apparatus CW, the engagement between the joints 56 of the core withdrawing devices 50 and the corresponding engaging hooks d1 of the cores d and the engagement between the struts 62 and the corresponding projections 46 on the die D1 (D2) may be automatically performed by utilizing the movement of the die D1 (D2) toward the opening position. Therefore, the core withdrawing devices 50 do not require any actuators for engaging the cores d. In addition, because the engagement of the cores d with the corresponding core withdrawing devices 50 may be completed at the same time that the opening operation of the die D1 (D2) is completed, the production cycle time may be minimized.

Furthermore, the forces in the withdrawing direction and the inserting direction applied to the cores d may be counterbalanced during the withdrawing and inserting operations of the cores d, respectively. Therefore, it is possible to minimize or prevent a load from being applied to the support frame 71 (that supports the core withdrawing devices 50) during the withdrawing operation. As a result, the strength of the support frame 71 is not required to take into account of such a load applied to the support frame 71. For this reason, it is not necessary for the support frame 71 of the representative embodiment to have a gate-like configuration. Instead, the support frame 71 may have a box-like configuration or a tubular configuration that has a part with an opening 90 as shown in FIG. 5. Such an opening 90 may be used effectively as a space for a pipeline(s) to a cylinder(s) that may serve as a drive source of the die opening apparatus 36 (38).

Moreover, after the casting operation has been performed, the cores d may closely adhere to the corresponding cast product within the die D1 (D2). Therefore, a relatively large force may be required to withdraw the cores d. According to the representative embodiment, the clearance C1+C2 may be provided for the struts 62 in order to support the die D1 (D2). Thus, each core drawing device 50 may be supported by the support frame 71 via the floating mechanism 80 and may be movable relative to the support frame 71 in the core withdrawing direction within the range of sum of the clearances C1 and C2 that are defined between the support plate 72 and the mounting plate 54 and between the support plate 72 and the movable plate 81, respectively. Therefore, when the cores d are withdrawn from the die D1 (D2) by actuation of the cylinder 71, the corresponding struts 62 may move in a direction that will reduce the clearances C1 and C2 at a predetermined speed so as to support the die D1 (D2). As a result, the withdrawing operation of the cores d can be impulsively performed, so that the cores d can be easily separated from the cast product even if the cores d have closely adhered to the cast product.

The present invention is not limited to the above representative embodiment but may be suitably modified without departing the spirit of the present invention.

For example, although the above representative embodiment has been described in connection with the die-exchange type die-casting system 10, in which two dies D1 and D2 are alternately carried into and out of the die-casting unit 11 in order to cast products, the present invention is not limited to such die-exchange type die-casting systems.

In addition, although the carriage rails 31, along which the die carriage 20 moves, is disposed on the ground, the carriage rails 31 may be disposed on a ceiling, so that the die carriage 20 moves along the carriage rails 31 in a suspended manner.

Further, although the die D1 (D2) is opened in the horizontal direction, the die D1 (D2) may be opened in the vertical direction or another direction.

Furthermore, although the core withdrawing cylinders 51 are supported on the support frame 71 via the floating mechanisms 80 in order to permit the movement of the cylinders 51 in the core withdrawing direction, the cylinders 51 may be fixedly mounted on the support frame 71. Even in such an arrangement, the struts 62 may be used to counterbalance the force in the core withdrawing direction.

What is claimed is:

1. A die-casting system comprising:

a core withdrawing device configured independently of a die and operable to withdraw a core from the die, the core being disposed within the die;

a die-casting unit located at a predetermined die-casting position, said die-casting unit arranged and constructed such that the core is withdrawn from the die at a predetermined die opening/closing position, to which the die is conveyed from the predetermined casting-position, the predetermined die-casting position being different from the predetermined opening/closing position; and a support frame independent from the die-casting unit and positioned at the predetermined die opening/closing position, wherein the core withdrawing device is mounted on the support frame.

2. A die-casting system as in claim 1, wherein the core withdrawing device further comprises a cylinder arranged and constructed to withdraw the core.

3. A die-casting system as in claim 2, wherein the core withdrawing device further includes a counterbalancing device that supports the die in order to counterbalance a force in a core withdrawing direction applied to the core when the core is withdrawn by actuation of the cylinder, and wherein the counterbalancing device includes a plate secured to one end of the cylinder.

4. A die-casting system as in claim 3, wherein a clearance is provided for the counterbalancing device in order to support the die, and the clearance is formed between the support frame and the plate to permit movement of the core withdrawing device in the core withdrawing direction relative to the support frame.

5. A die-casting system as in claim 1, wherein the core withdrawing device is arranged and constructed to engage the core as the die is opened after the die has been removed from the die-casting unit.

6. A die-casting system as in claim 5, wherein the die is arranged and constructed to open in a horizontal direction.

7. A method for withdrawing a core from a die in a die-casting system, the core being disposed within the die, comprising:

positioning a core withdrawing device at a predetermined die opening/closing position, wherein the core withdrawing device is mounted on a support frame that is at the predetermined die opening/closing position and independent from a die-casting unit located at a predetermined die-casting position, the predetermined die-casting position being different from the predetermined opening/closing position; and withdrawing the core from the die by using the core withdrawing device when the die has been conveyed from the predetermined die-casting position to the predetermined die opening/closing position after a casting operation has been performed, the core withdrawing device being configured independently of the die.

8. A method of withdrawing a core from a die in a die-casting system, the core being disposed within the die, comprising:

positioning a core withdrawing device at a predetermined die opening/closing position, wherein the core withdrawing device is mounted on a support frame that is at the predetermined die opening/closing position and independent from a die-casting unit located at a predetermined die-casting position, the predetermined die-casting position being different from the predetermined opening/closing position;

moving the die near the core withdrawing device from the die casting position in order to engage the core with the core withdrawing device at the predetermined opening/closing position, the core withdrawing device being configured independently of the die; and actuating the core withdrawing device, thereby withdrawing the core.

9. A method as in claim 8, wherein the core is engaged by the core withdrawing device as the die is opened.

10. A method as in claim 9, wherein the core withdrawing device automatically engages the core as the die is opened.

11. A method as in claim 10, further including counterbalancing a force applied to the core by the core withdrawing device when the core withdrawing device withdraws the core.

12. A method as in claim 8, further including counterbalancing a force applied to the core by the core withdrawing device when the core withdrawing device withdraws the core.

13. A method for withdrawing a core from a die in a die-casting system, comprising the steps of:

disposing the core within the die;

configuring a core withdrawing device independently of the die;

mounting the core withdrawing device on a support frame at a predetermined opening/closing position that is independent of a die-casting unit located at a predetermined casting position, the predetermined die-casting position being different from the predetermined opening/closing position;

moving the die from the die-casting position towards the core withdrawing device at the predetermined opening/closing position in order to engage the core with the core withdrawing device; and actuating the core withdrawing device, thereby withdrawing the core.

* * * * *